US007575049B2

(12) United States Patent
Stowe et al.

(10) Patent No.: US 7,575,049 B2
(45) Date of Patent: Aug. 18, 2009

(54) EXIT WINDOW MILLING ASSEMBLY WITH IMPROVED RESTRAINING FORCE

(75) Inventors: Calvin J. Stowe, Bellaire, TX (US); Evan G. Lewis, Kingwood, TX (US); Mohan L. Soni, Katy, TX (US); Daniel R. Hart, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 262 days.

(21) Appl. No.: 11/434,358

(22) Filed: May 15, 2006

(65) Prior Publication Data

US 2007/0261840 A1 Nov. 15, 2007

(51) Int. Cl.
*E21B 29/06* (2006.01)
*E21B 7/08* (2006.01)

(52) U.S. Cl. ..... 166/117.5; 175/79

(58) Field of Classification Search ..... 166/117.5, 166/117.6, 55.3; 175/79, 80
See application file for complete search history.

(56) References Cited

U.S. PATENT DOCUMENTS 5,109,924 A 5/1992 Jurgens et al.
5,887,655 A * 3/1999 Haugen et al. ..... 166/298
6,102,123 A * 8/2000 Bailey et al. ..... 166/313
6,302,198 B1 * 10/2001 Ritorto et al. ..... 166/55.1
6,488,090 B1 * 12/2002 Ohmer ..... 166/298
6,648,068 B2 * 11/2003 Robin et al. ..... 166/50
6,715,567 B2 * 4/2004 Delgado et al. ..... 175/61
6,840,320 B2 * 1/2005 Dewey et al. ..... 166/297
2002/0060096 A1 * 5/2002 Brunnert et al. ..... 175/81
2002/0096325 A1 * 7/2002 Sonnier ..... 166/255.3
2002/0162658 A1 * 11/2002 Delgado et al. ..... 166/298
2006/0254824 A1 * 11/2006 Horst et al. ..... 175/61

OTHER PUBLICATIONS

Nazzal, Greg, et al., "Development, Testing and Field History of a True One Trip Casing Exit System", SPE 35662, May 1996, 1-10.
Hinojosa, Robert, et al, "Whipstock Performance Review in Gulf Coast Region Yields Operational", IADC/SPE 39402, Mar. 1998, 1-6.

(Continued)

*Primary Examiner*—Shane Bomar
(74) *Attorney, Agent, or Firm*—Steve Rosenblatt

(57) ABSTRACT

An assembly for milling a window in a tubular features a layout that keeps a restorative force normal to the whipstock slope acting on the window mill to help it track the whipstock ramp long enough for making an exit at the desired location. A string mill assembly is made long enough to allow such a restorative force to be created on the window mill as it advances down the ramp. The bearing or cutting structures on the string mill are positioned with respect to the window mill so that either the top of the string mill or at least the first bearing structure above the window mill presents at the top of the window as the window mill arrives at the position where it is desired that it make an exit. The lower bearing structure of the string mill also preferably has a rounded profile to facilitate its entrance on to the whipstock ramp without getting in a bind on the tubular wall adjacent the top of the window.

20 Claims, 1 Drawing Sheet

OTHER PUBLICATIONS

Desai, Praful, et al., "Innovative casing exit system for CT/TT applications: System description, Validation surface test and filed runs", SPE 81740, Apr. 2003, 1-7.

Dooley, Lynn B., et al., "Planning and Execution fo a Ling, Tight Cleamace Liner Through a Whipstock Milled Window", IADC/SPE 87167, Mar. 2004, 1-11.

* cited by examiner

EXIT WINDOW MILLING ASSEMBLY WITH IMPROVED RESTRAINING FORCE

FIELD OF THE INVENTION

The field of this invention relates to window milling techniques and more specifically assemblies that facilitate making a full window by avoiding an early window mill exit while preventing binding of the string mill as it encounters the whipstock.

BACKGROUND OF THE INVENTION

Frequently, lateral exits have to be made from existing wellbores to access additional production. This typically involves orienting and anchoring a whipstock to direct one or more mills laterally to make an elongated opening in the casing. This technique has been around for a long time and has been the target of efforts to optimize it. One of the advances made was to produce the window in a single trip by running in a whipstock with a series of mills. The initial mill, known as the window mill was secured to a lug near the top of the whipstock and that connection sheared with the application of weight before milling. Behind the window mill were additional mills, known as string mills or watermelon mills. Watermelon mills are so named due to their more rounded profile. When used in this application, either term, unless specifically modified, is intended to cover mills that have straight or curved bearing structure or blades. The rounded or straight larger diameter could also have a combination of bearing and cutting structures. Illustrative of an early effort to make a window in a single trip was Jurgens U.S. Pat. No. 5,109,924. This reference featured a window mill 6 close coupled to the lower watermelon mill 14 and a reduced diameter flexible joint 15 located right above the lower watermelon mill 14 so that the rigid assembly of the window mill 6 and the watermelon mill 14 could make the bend onto the whipstock ramp which was usually in the order of about 2°. The rigidity of three close coupled mills was too great to make this bend, requiring a reduced diameter, more flexible joint between the two upper mills and the two lower mills. Additionally the two lower mills were nowhere close to the inside or gauge diameter of the tubular in which the assembly was anchored. In that manner the flexible joint and reduced lower mill diameters allowed the assembly to avoid binding as it turned onto the whipstock and eventually exited into the formation.

Eventually, the market evolved to demand not only to mill the window, but to continue and drill the lateral where the lateral diameter approached the main bore diameter as closely as possible. Another issue that came up with layouts like Jurgens was early exit of the window mill from the whipstock which resulted in the window being shorter than the length intended. It was learned that a way to avoid early exits into the casing and formation was to configure the system to have a restorative force acting on the window mill and acting in a direction normal to the ramp surface. The way this force is generated is a reaction moment from the window mill being deflected by the whipstock ramp and the mill(s) above it being constrained within the tubular. Thus to increase the restraining force on the window mill, it was desirable to have a fairly long watermelon mill. A longer watermelon mill could induce and withstand more bending force and in turn create a greater reaction moment at the window mill that was desired to help the window mill track on the whipstock face.

The problem with a longer string mill was that as it reached the beginning of the whipstock ramp it would get in a bind at the top of the window because of its length and large diameter.

While being longer promoted a greater reactive force helping the window mill track on the whipstock ramp to the desired point it made it difficult if not impossible to clear the watermelon mill onto the ramp and out the already made window made by the relatively short window mill.

When the Jurgens system was deployed with mills approximating the drift or clearance diameter of the tubulars, the close coupling of the window and watermelon mill became severely stressed and the connection between those mills experienced failures. The other problem with Jurgens was early exits of the window mill 6 into the formation. This happened because the watermelon mill 14 prevented the restraining force from acting on the window mill 6. As long as watermelon mill 16 was still in the surrounding tubular there was still some restraining force on the mills 6 and 14 to make them track along the whipstock face. However the presence of watermelon 14 substantially diminished the effectiveness of this force allowing the window mill to exit early particularly in soft formation. When watermelon mill 16 got on top of the whipstock ramp the value of that normal restraining force went to zero.

One solution attempted before was to insert a long, smaller diameter tubular between the window mill and a single watermelon mill. While this solved the load transfer issue of having the watermelon mill adjacent the window mill it also provided for an insufficient restorative force on the window mill on relatively long systems which led to short windows being milled as the window mill made an early exit.

The present invention resolves the issue of window length by providing a sufficient restraining force on the window mill through the use of a string mill assembly of sufficient length and diameter to create such a force. At the same time the invention resolves the binding problem as the string mill tilts up on top of the whipstock by providing spaced bearing or cutting structures and a more rounded profile on the lead watermelon mill. As a result at the time the window mill reaches the location where it needs to go out into the formation the reduced diameter shaft between the cutting structures on the bottom hole assembly presents itself at the top of the window to allow the assembly to bend and tilt without getting bound up as the window mill leaves the whipstock. These and other features of the present invention will become more apparent to those skilled in the art from a review of the detailed description of the preferred embodiment, the drawings and the claims which define the full scope of the invention that all appear below.

SUMMARY OF THE INVENTION

An assembly for milling a window in a tubular features a layout that keeps a restorative force normal to the whipstock slope acting on the window mill to help it track the whipstock ramp long enough for making an exit at the desired location. A string mill assembly is made long enough to allow such a restorative force to be created on the window mill as it advances down the ramp. The bearing or cutting structures on the string mill are positioned with respect to the window mill so that either the top of the string mill or at least the first bearing structure above the window mill presents at the top of the window as the window mill arrives at the position where it is desired that it make an exit. The lower bearing structure of the string mill also preferably has a rounded profile to facilitate its entrance on to the whipstock ramp without getting in a bind on the tubular wall adjacent the top of the window.

In a preferred embodiment, the distance between the assemblies includes a window mill at the lower end thereof and a lower bearing structure spaced apart longitudinally from the window mill at a distance preferably at least half of the length of the ramp. In one aspect, the lower bearing structure has a diameter approximating either or both of the whipstock or the inside of the tubular being exited. In another aspect, the lower bearing structure is a cutting structure, but it may also be a non-cutting structure and may be constructed with a lubricious or friction reducing material such as bronze to reduce the torque or drag transmitted thereto. In a cutting structure embodiment, the cutting structure may be encased in or include a sacrificial friction reducing component so as to prevent premature milling or inducement of torque until the window opening to be milled is reached. In yet another embodiment, an upper bearing structure may be provided, which is spaced apart from the lower bearing structure preferably an upper bearing spacing distance less than the spacing between the lower bearing structure and the window mill, but it may be spaced apart a greater distance provided the lower bearing spacing exceeds half of the length of the ramp. In still another embodiment, the upper bearing structure may also include cutting elements so as to be an upper cutting structure. A further embodiment is an upper and/or lower bearing with a combination of cutting and non-cutting structure.

DETAILED DESCRIPTION OF THE PREFERRED EMBODIMENT

Figures 1, 2, 3, 4, 5, 6:
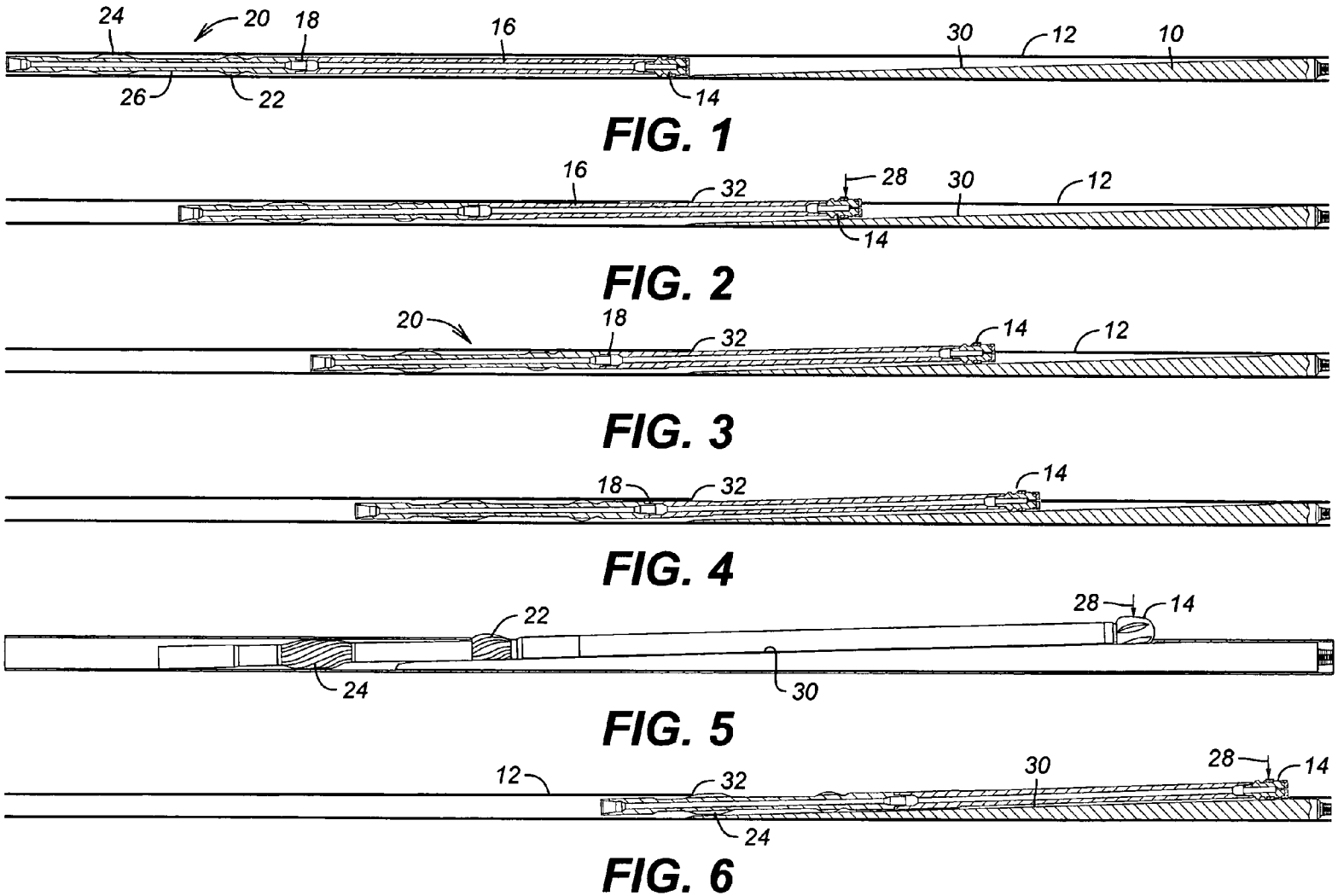
FIG. 1 is the bottom hole assembly in the run in position.
FIG. 2 is the view of FIG. 1 where the window mill has opened a window wide enough so as to not be constrained by the remaining tubular wall.
FIG. 3 is the view of FIG. 2 with the center of the bottom hole assembly through the casing wall.
FIG. 4 is the view of FIG. 3 slightly more advanced to the position where the center of the window mill is at the casing wall.
FIG. 5 is the view of FIG. 4 where the common shaft between watermelon mill cutters presents at the top of the window.
FIG. 6 shows the watermelon mill through the window so that there is no lateral constraint on the window mill.

Referring to FIG. 1, a whipstock 10 is properly oriented inside a tubular 12 which in many cases is casing. The anchor below the whipstock is not shown. The bottom hole assembly comprises a window mill 14 secured to a lug (not shown) on the whipstock 10 so that the whipstock 10 can be run in supported of window mill 14 in a known manner. A long flex joint 16 such as a Windowmaster® G2 LF Flex Joint sold by Baker Hughes Incorporated ends at a connection 18. The watermelon mill assembly 20 has a lower bearing section 22, which may in a preferred embodiment include cutting or milling structure thereby providing a bearing section 22 which is also a cutting section 22. The bearing section 22 may also preferably be connected to an upper bearing section 24 which may in a preferred embodiment also include cutting or milling structure or elements thereon thereby providing a bearing section 24 which is also a cutting section 24. The lower bearing section 22 and upper bearing section 24 are preferably on a common shaft 26. The bearing section may be comprised of a low friction, torque reducing material, made of or encapsulated at least partially within bronze or other lubricious material, and additional cutting structure, cutting elements, or milling sections may be provided at full diameter above the lower bearing section, or at smaller diameters than the lower bearing section and located between the lower bearing section and the window mill.

The profile of the lower bearing section 22 is rounded and relatively short compared to the upper cutting section 24. The assembly 20 is relatively rigid so that when it is in the casing 12 as shown in FIG. 2 and the window mill 14 moves along the whipstock ramp that is in the order of about 2 degrees in slope the tendency of the flex joint 16 to bend creates a restorative force indicated by arrow 28 in a direction normal to the ramp 30 on the whipstock 10. This is a desirable feature that helps the window mill 14 track the ramp 30 under the effect of a restorative force 28.

In FIG. 2, the mill 14 has cut away enough of the surrounding casing 12 so that the window is sufficiently wide so as to no longer provide any force laterally on the mill 14 to keep it on track against whipstock ramp 30. For that reason, in FIG. 2 the watermelon mill assembly 20 being still in the casing 12 acts to provide the restorative force 28 in conjunction with flexing of flex joint 16.

FIGS. 3 and 4 show further advancing of the mill 14 as the bending moment at connection 18 rises as does the magnitude of the offsetting moment which is the restorative force 28. In these two views, the watermelon mill assembly 20 is still in the casing 12 above the window 32.

Since the lower watermelon mill is close to full gauge, the potential exists to get it into a bind when enters ramp 30 in the vicinity of window 32. FIG. 5 shows mill 22 in the window with the smaller diameter shaft 26 abutting the top of the window. The relative shortness of the mill 22 as compared to mill 24 as well as the roundness of the profile of mill 22 allows it to get up on the ramp 30 without getting hung up. Right behind it is shaft 26 which has a smaller diameter than mill 22 to let the mill 22 advance and be laterally shifted by ramp 30 without hanging up as it gets by the top of the window 32. While this goes on, mill 14 is still under a restorative force 28 that has now decreased in magnitude upon the arrival of mill 22 at the ramp 30 and the window 32. At this point only mill 24 and a part of shaft 26 are still within the tubular.

FIG. 6 illustrates further advancing and now the mill 24 is on top of the ramp 30 and the lateral force 28 on the mill 14 is dramatically diminished and the mill 14 has cut the window long enough so that it is at the appropriate location to start drilling the lateral by moving away from the ramp 30.

Those skilled in the art will appreciate some of the features of the present invention and how they solve the problem of making short windows by promoting a force 28 acting on mill 14 to help it track the ramp 30 to a desired spacing from the top of the window at which time the lateral forces on the mill 14 are greatly diminished. Mill 22 needs to be spaced from mill 24 and preferably have a rounded profile. What this does is reduce the contact at mill 22 as it gets up on the ramp 30 to close to a point contact due to the rounding of the exterior of the blades. That coupled with the short length of mill 22 compared to mill 24 allows the mill 22 to get by the angle change at the top of the ramp 30 on one side and the top of window 32 on the other side. Being of the smaller diameter, the shaft right above the mill 22 allows the mill 22 to move further laterally as it enters the window. When the smaller diameter shaft is adjacent to the top of the window it allows the mill 22 to move out further again without binding. Preferably the mill 24 is at least twice as long as mill 22. The whipstock is configured so that mill 14 is at the targeted point along the whipstock when the mill 24 advances on top of the whipstock. A long flex joint 16 is required of a length at least half of the ramp 30. The mill 22 being relatively short and preferably rounded exhibits small enough interference and the smaller diameter shaft right behind mill 22 which provide a tracking force on window mill 14 along ramp 30 while allowing the mill 22 to make an exit without getting in a bind near the top of ramp 30.

The present invention combines an assembly above the mill 14 that keeps it tracking the ramp 30 for the desired distance while at the same time configuring the mill that is above 22 to have a shape and length in combination with a smaller shaft behind it so as to allow greater bending without binding as mill 22 is reduced to preferably a point contact when getting up on the ramp 30 and can move laterally that much more as shaft 26 approaches the top of the window shortly after mill 22 makes the point contact on the ramp 30. Thus an assembly 20 which exhibits very small angular tilting inside the tubular can be used to enhance tracking by mill 14 on ramp 30 while still being able to get out into the window even when the maximum diameter of the system 20 is approximately the drift of the tubular 12.

Those skilled in the art will appreciate that the present invention configures a bottom hole assembly that comprises a window mill that operates with a force that keeps it tracking the whipstock face to avoid early exits into formations particularly when they are fairly soft. A portion of the bottom hole assembly that is still in the tubular and above the whipstock creates this tracking force on the window mill 14 along a desired portion of the whipstock ramp 32. That portion of the assembly inside the tubular can be one or more bearings and/or mills such as 22 and 24. Configurations of spacing and number of mills or bearings can vary with the goal being the creation of a tracking force for the window mill on the whipstock until it makes a long enough window and moves into the formation. Associated with that concept is to configure the bearing or/and milling profiles to clear out into the window after getting on the whipstock ramp. Along those lines, the length and profile of a mill and/or bearing can be varied. The shaft size above the lowermost bearing/mill that is in turn above the window mill also helps that lowermost bearing and/or mill move laterally though the window and reduces the risk of getting stuck at the top of the whipstock ramp. A flexible shaft 16 can connect the window mill 14 to the bearing and/or mill 22 or they can be close coupled or some dimension in between. The configuration needs to provide a tracking force to the window mill to make a long enough window while the bearing and/or mill that creates that tracking force needs to clear the top of the whipstock ramp and out the window without getting jammed in the tubular due to the sloping nature of the whipstock ramp. Hence elliptical or rounded profiles on the lowermost bearing and/or mill helps with that as does having a smaller diameter shaft right above so that the lower bearing and/or mill can cock when mounting the ramp and can move laterally to let, for example, a lower watermelon mill get over laterally as it widens the window made by the window mill.

Bearing and or mill 22 also promotes lateral stability to window mill 14 as the window is made. There is less drift of the window to the left or right when the window mill 14 advances on ramp 32. As the window mill moves further along ramp 32 this lateral stabilizing force increases as does the force that acts on the window mill that helps it track along the ramp 32. Preferably the upper bearing and/or mill 24 has cutting structure on all but it uppermost segment that preferably comprises about the top fourth of its length. This allows bearing/mill 24 to cock when reaching ramp 32. A cutting structure on at least a portion of both 22 and 24 is preferred.

The above description is illustrative of the preferred embodiment and many modifications may be made by those skilled in the art without departing from the invention whose scope is to be determined from the literal and equivalent scope of the claims below.

We claim:

1. A window milling assembly in a tubular, comprising:

a whipstock comprising an initially uncovered ramp;

a window mill further comprising a shaft rigidly connected to said window mill and connected to at least one bearing, said bearing movable within the tubular such that as the window mill creates the window, said at least one bearing, when wholly within the tubular, produces bending in said shaft that results in a restorative force on said window mill to retain said mill against said ramp to promote tracking of said window mill on said ramp until said window mill advances substantially the length of said ramp.

2. The assembly of claim 1, wherein:

said bearing further comprises a mill.

3. The assembly of claim 2, wherein said bearing has a rounded profile.

4. The assembly of claim 3, wherein:

said bearing comprises a shaft extending in a direction away from said window mill and having a smaller diameter than the maximum diameter of said bearing to facilitate lateral movement of said bearing as it mounts said ramp.

5. The assembly of claim 1, wherein:

said bearing provides force on said window mill to give it lateral stability as it advances along said ramp.

6. The assembly of claim 1, wherein:

said window mill advances to at least half way down said ramp before said bearing reaches a top of said ramp.

7. The assembly of claim 1, wherein:

said applied force is substantially reduced when said bearing passes a top of said ramp.

8. The assembly of claim 1, wherein:

said at least one bearing comprises a lower bearing closer to said window mill and an upper bearing connected to said lower bearing by a smaller diameter shaft than said lower bearing.

9. The assembly of claim 8, wherein:

the spacing between said window mill and said lower bearing exceeds the spacing between said bearings.

10. The assembly of claim 8, wherein:

the spacing between said window mill and said lower bearing does not exceed the spacing between said bearings but does exceed half the length of said ramp.

11. The assembly of claim 8, wherein:

at least one of said bearings has a cutting structure for at least a part of its length.

12. The assembly of claim 11, wherein:

at least one of said bearings has a rounded profile.

13. The assembly of claim 12, wherein:

the uppermost portion of said upper bearing is not a cutting element.

14. The assembly of claim 8, wherein:

said smaller diameter shaft enables said lower bearing to tilt when reaching said ramp.

15. The assembly of claim 14, wherein:

said lower bearing comprises a cutting structure that widens the window while approaching and mounting the top of the ramp.

16. The assembly of claim 8, wherein:

said lower bearing provides force on said window mill to give it lateral stability as it advances along said ramp.

17. The assembly of claim 8, wherein:

said window mill advances to at least half way down said ramp before said lower bearing reaches a top of said ramp.

18. The assembly of claim 8, wherein:

said applied force declines rapidly when said lower bearing passes a top of said ramp.

19. The assembly of claim 8, wherein:

the spacing from said upper bearing to said window mill is no longer than half the length of said ramp.

20. The assembly of claim 8, wherein:

said smaller diameter shaft between said bearings is substantially inflexible.

* * * * *